US005655625A

United States Patent [19]

Barker et al.

[11] Patent Number: 5,655,625

[45] Date of Patent: Aug. 12, 1997

[54] EMERGENCY ELEVATOR CAB COMMANDEERING SHUTTLE

[75] Inventors: Frederick H. Barker, Bristol; LucyMary Salmon, Windsor; Paul Bennett, Waterbury; Anthony Cooney, Unionville; Richard C. McCarthy, Simsbury; Joseph Bittar, Avon; Bruce A. Powell, Canton; Samuel C. Wan, Simsbury, all of Conn.

[73] Assignee: Otis Elevator Company, Farmington, Conn.

[21] Appl. No.: 564,773

[22] Filed: Nov. 29, 1995

[51] Int. Cl.[6] ..... B66B 9/00

[52] U.S. Cl. ..... 187/249; 187/239

[58] Field of Search ..... 187/249, 239, 187/240, 289, 277, 380, 382, 390

[56] References Cited

U.S. PATENT DOCUMENTS

| | | | |
|---|---|---|---|
| 1,580,310 | 4/1926 | Lepley | 187/12 |
| 1,949,399 | 3/1934 | Ayer | 187/1 |
| 4,865,155 | 9/1989 | Montaigne et al. | 182/14 |
| 5,090,515 | 2/1992 | Takahashi et al. | 187/249 |
| 5,433,293 | 7/1995 | Sager | 187/249 |

FOREIGN PATENT DOCUMENTS

| | | |
|---|---|---|
| 4-153187 | 5/1992 | Japan . |
| 4-361968 | 12/1992 | Japan . |
| 1442212 | 7/1976 | United Kingdom . |

OTHER PUBLICATIONS

Strackosch, G.R.; "Vertical Transportation: Elevators and Escalators", pp. 472–475; New York: 1983.

*Primary Examiner*—Kenneth Noland

[57] ABSTRACT

A particular elevator (1–9) is commandeered to transfer an emergency cab F to (or near) a floor where an alarm has been sounded. The commandeered car is brought to the floor FF where the emergency cab is parked. The fire cab is exchanged for the normal cab C on the commandeered car, and is then carried to (or near) the alarm floor for responding to the alarm. Passengers in the normal cab may exit through landing doorways (23). Emergency personnel have access to the alarm area through emergency hoistway doors (27). A rack and pinion horizontal motive means for moving the cabs is illustrated (FIG. 12 ).

5 Claims, 12 Drawing Sheets

17
1
2
3
4
5
6
7
8
9
20
F
27
12
16
14
13
15

EMERGENCY ELEVATOR CAB COMMANDEERING SHUTTLE

TECHNICAL FIELD

This invention relates to the commandeering of an elevator shuttle car frame to carry an emergency cab to a floor where an alarm is registered.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and energy consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth. Since the loading and unloading of passengers takes considerable time, in contrast with high speed express runs of elevators, another way to increase hoistway utilization, thereby decreasing core requirements, includes moving the elevator cab out of the hoistway for unloading and loading.

In buildings which are sufficiently tall to have banks of shuttle elevators that are many hundreds of meters high, particularly when such buildings have 24 hour usage (such as residences) it is unlikely that adequate emergency service, such as fire and medical, can be provided utilizing equipment dispatched from the ground.

DISCLOSURE OF INVENTION

Objects of the invention include provision of emergency medical cabs in very tall buildings; movement of emergency cabs to various floors in very tall buildings in response to alarms registered at other floors in the buildings; and rapid deployment of emergency medical equipment in very tall buildings, without inefficiently impacting the building core.

According to the present invention, in response for a request for emergency service, one of a plurality of adjacent elevators is selected to be commandeered, it is brought to a floor where an emergency cab is parked, the normal cab is exchanged for the emergency cab, and the emergency cab is brought to the floor where the alarm is registered. In further accord with the invention, after responding to the emergency, the emergency cab is returned to the floor where it parks and the normal cab is exchanged therefor. In still further accord with the invention, the commandeered elevator may be returned to a designated floor, such as a low lobby, to resume normal service.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
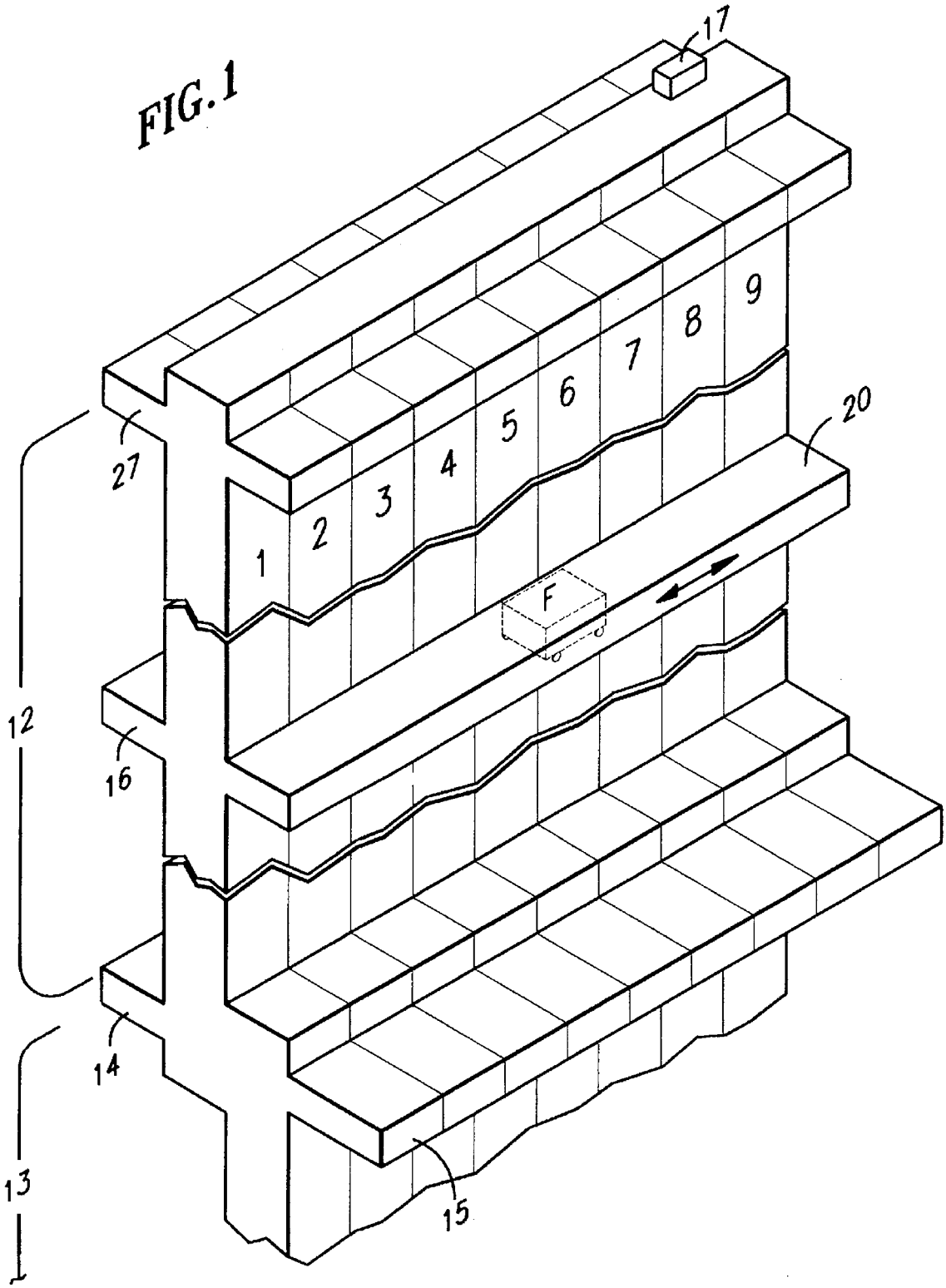
FIG. 1 is a stylized, simplified perspective illustration of a bank of interconnected elevator shuttles which may accommodate the present invention.

Referring now to FIG. 1, a plurality of elevators 1–9 comprise an upper bank 12, the elevator cars of which can transfer to a lower bank 13 of elevators at a transfer floor 14. Substantially midway along the bank 12, landings 16 are provided on one side of the hoistways of the elevators 1–9, opposite which a single landing 20 accommodates a fire cab F which can transfer horizontally in response to a controller 17 so as to be exchangeable for a cab on any one of the elevator cars 1–9. When a fire alarm is registered, one of the cars 1–9 is selected to become commandeered, after which, the fire cab F will move horizontally (arrow, FIG. 2) to be positioned adjacent the selected car C, and then exchange cabs therewith so that the selected elevator can take the fire cab F to the floor where the fire is, referred to herein as the alarm floor. Of course, if the fire is on the floor where the fire cab F is housed, which is referred to herein as the fire floor, FF, then the fire cab is not moved to any other floor, so no cab selection or cab exchange process is required.

Figure 2:
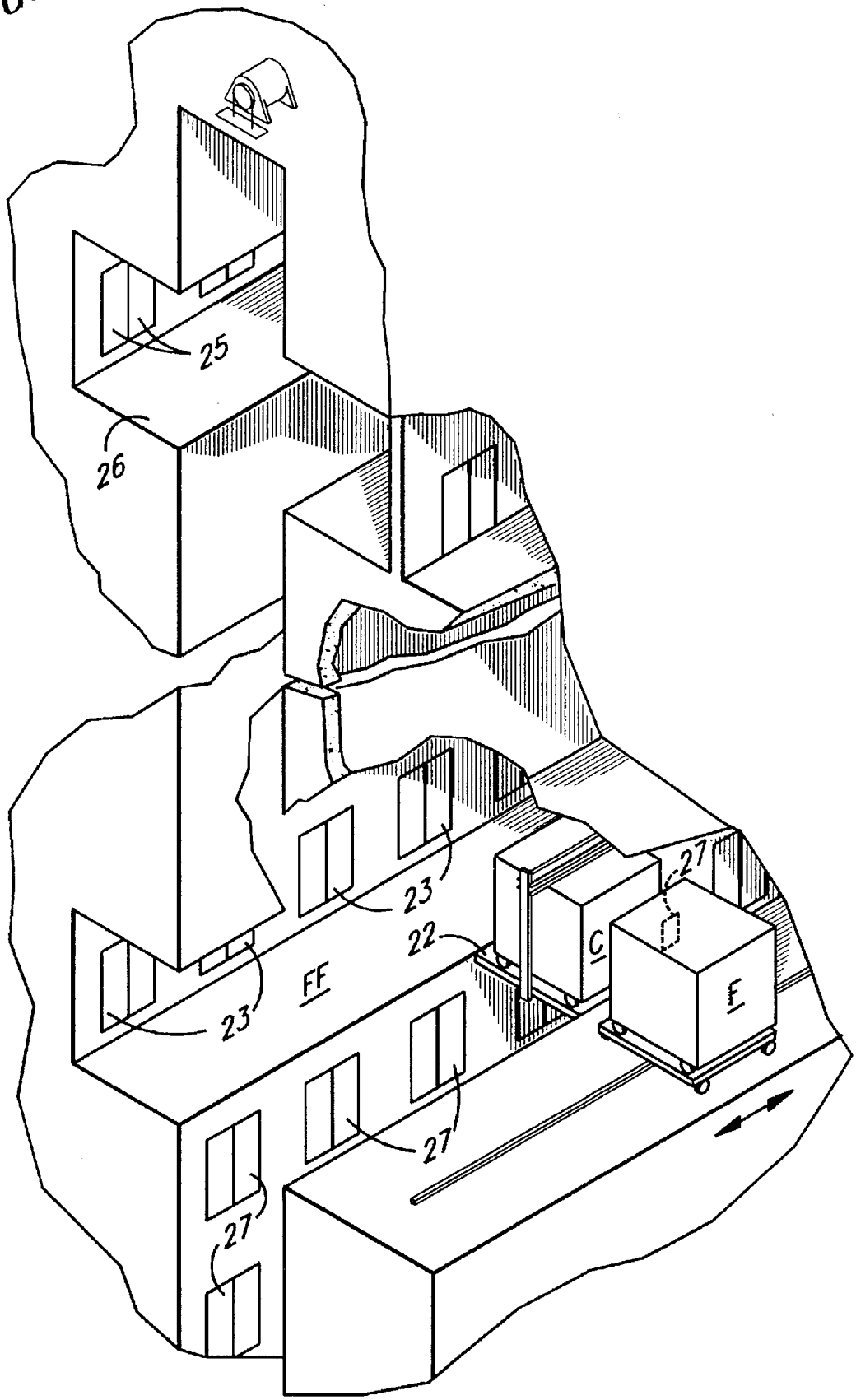
FIG. 2 is a partial, partially broken away perspective view of a fire cab as it commandeers the car frame of an elevator shuttle, according to the invention.

In FIG. 2, when one of the elevators 1–9 has been selected to be commandeered, which is referred to herein as car C, and its car frame 22 has been arrested at the fire floor FF, the fire cab F will have moved horizontally parallel to the row of elevators, such as by means of a linear induction motor and casters, to be juxtaposed therewith. The cabs can be exchanged horizontally by a horizontal motion means In the embodiment of FIGS. 1 and 2, each of the landings of the elevators 1–9 on the fire floor have hoistway doors 23 leading from those landings into the building. These are similar to hoistway doors 25 on the terminal landings 26 of the shuttle elevators, as described in the aforementioned application. On the other hand, all of the remaining floors which are neither the fire floor nor the terminal floors simply have hoistway doors 26 of a conventional type which open directly into the hoistway, rather than onto a landing, to provide access into the building both for the fire service to be provided from the fire cab F, as well as for emergency egress of passengers, should such become necessary at any floor (unrelated to the present invention). Of course, in any building in which the invention is practiced, if fire protocol requires stopping and emptying every elevator, then the emergency doors 26 would be utilized for passenger egress in that case. The fire cab F has a car operating panel 27 with door open and close switches, typically key operated.

Figure 3A:
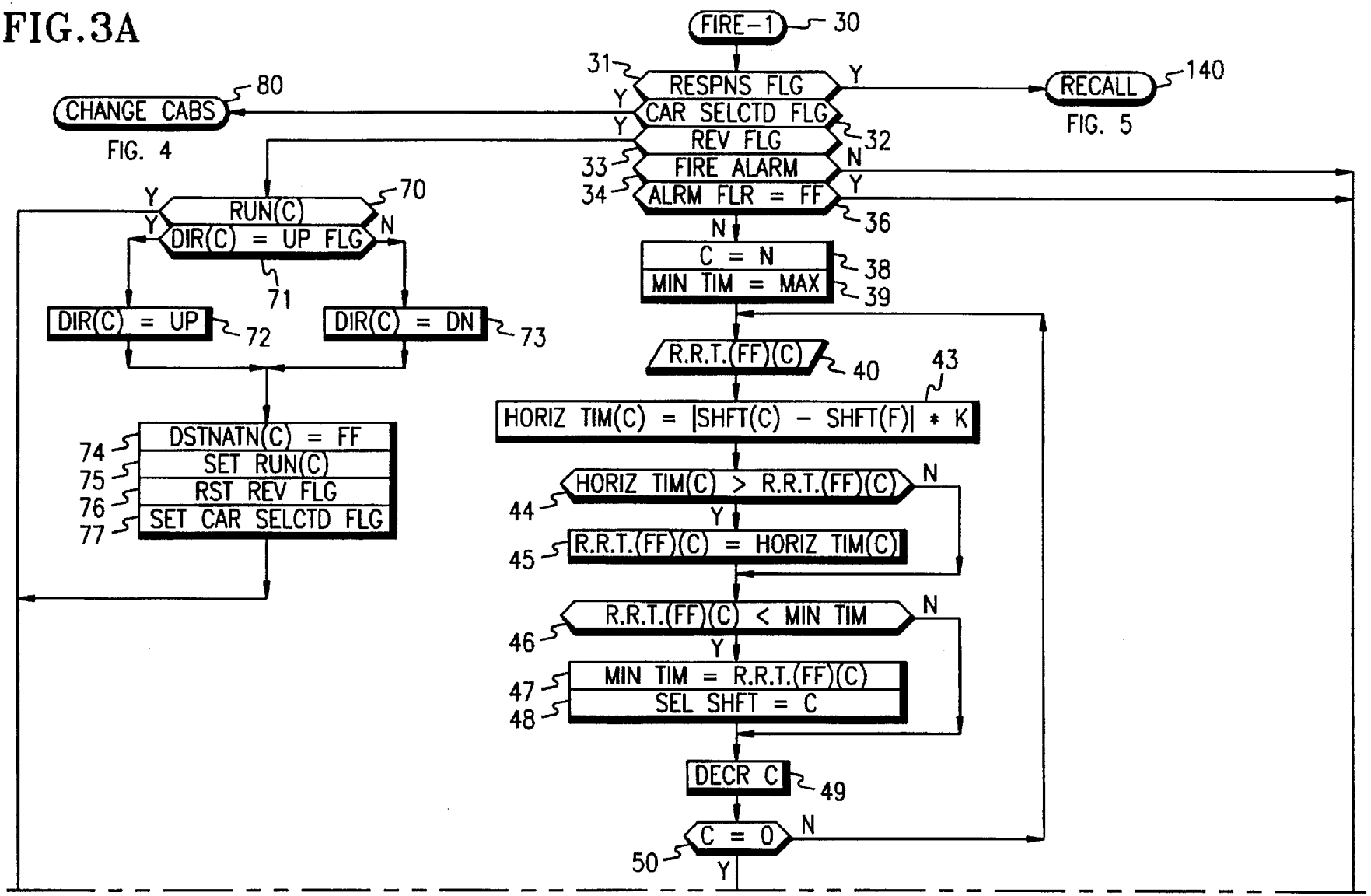
FIG. 3 is a logic flow diagram of a fire routine for commandeering a shuttle in the embodiment of FIGS. 1 and 2 utilizing universal selection of the best car to respond.
Figures 3, 3A, 3B:
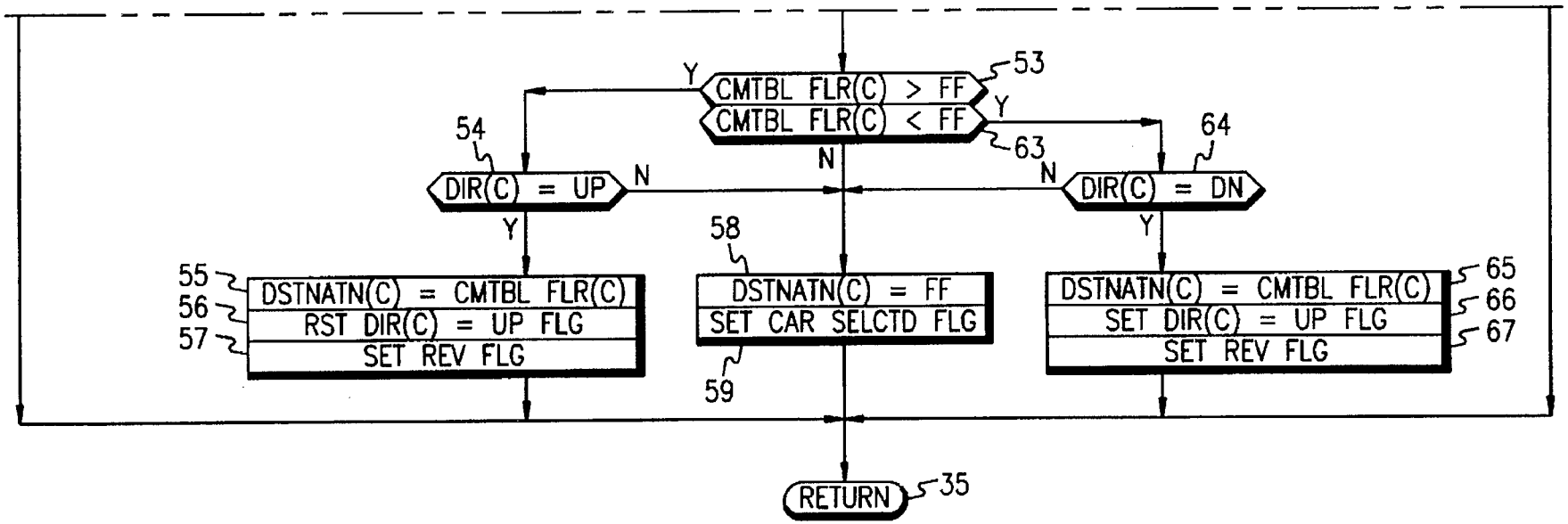

Referring now to FIG. 3, a first embodiment of a fire routine for use in the embodiment of FIGS. 1 and 2 is reached through an entry point 30, and a first test 31 determines if a response flag (utilized to advance the program as described hereinafter) has been set as yet or not. Initially, it will not have been so a test 32 determines if a car selected flag (also used to advance the program as described hereinafter) has been set or not. Initially it will not have been so a test 33 determines if a reverse flag (also utilized to advance the program as referred to hereinafter) has been set or not. Initially it will not have, so a negative result of test 33 reaches a test 34 to see if a fire alarm has been registered. In the general, day-to-day case, there will not be a fire, and a negative result of test 34 will cause the program to advance directly to a return point 35 so that other programming may be reverted to. This will happen many times per second in the usual course of a normal day.

Should a fire alarm be registered, negative results of tests 31–33 will reach test 34 which will now be positive, reaching a test 36 to see if the alarm floor (the floor where the fire alarm is registered) is the fire floor. If so, the fire cab need not be moved so the rest of the routine is bypassed. But if the alarm has been registered on other than the fire floor, a negative result of test 36 reaches a step 38 to set a car counter, C, to the number of cars in the bank (nine in this example), and a step 39 to set a minimum time to some maximum value for purposes to be described. Then a subroutine 40 is reached to calculate the remaining response time for car C (beginning with car 9) to reach the fire floor, FF. This may be done in any number of well-known ways which typically take into account whether the car is traveling toward or away from the fire floor, how many floors separate it, provide time to turn around if it is heading away from the fire floor, and so forth. However, because these are shuttle cars, and traveling a great expanse (such as on the order of 80 floors between the terminal landings 14, 25) the likelihood is very great that an appropriate car can be chosen without considering those approaching or at a terminal landing. In fact, as is seen hereinafter, any cab which is at or approaching a landing can be given a disqualifying maximum penalty (or otherwise excluded from consideration) since such cabs generally will not be desirable to respond to a fire call. However, the nature of remaining response time algorithm chosen will depend upon the particular utilization of the invention.

Assuming the cab to be stored in the middle adjacent hoistway 5 is as shown in FIG. 1, the time required for the fire cab F to reach either hoistway 1 or hoistway 9 is greater than the time required to reach hoistway 4 or hoistway 6. Since one of the cars at the end may be closest to the fire floor, but other cars nearly as close, the amount of time for the fire cab F to reach such an elevator is taken into account by a step 43 which calculates the horizontal time to reach car C as the absolute value of the difference between the shaft number e.g. 9 minus 5 times a constant, K. Then a test 44 determines if this time is greater than the remaining response time for that particular car to reach the fire floor. If it is, an affirmative result takes the remaining response time for that car to be equal to the time it will take the fire car cab to reach the landing of that car in a step 45. However, if the fire cab can reach the car landing by the time the car will reach the fire floor, then a negative result of test 44 bypasses the step 45. A test 46 determines if the remaining response time for each car is less than minimum time. For the first car (car 9 in this example) it will automatically be less because the min time has been set to some maximum value in the step 39. If the remaining response time for the car being examined is lower than any heretofore, an affirmative result of test 46 reaches a step 47 to substitute the remaining response time of the cab in question for the minimum time for further tests, and a step 48 to designate the car being examined as the one (so far) selected to be commandeered. Then a step 49 decrements the C counter and a test 50 determines if all the cars have been examined yet or not. If not, a negative result of test 50 causes the program to revert to the subroutine 40 to be performed on the next car in sequence, and so forth. Eventually, all the cars will have been tested and one which can respond most quickly (including the time required for the fire cab F to reach the landing of the car) will have been selected as car C.

A test 53 determines if the committable floor of the selected car (that is, the nearest floor at which it could stop) is above the fire floor. If it is, then a test 54 determines if the selected car is going up, and therefore away from the fire floor. If it is, the car must stop and turn around so a step 55 sets the destination for the selected car to be equal to its committable floor and resets a direction for car C equal up flag in a step 56, for use hereinafter, and then a step 57 will set a reverse flag described below. On the other hand, if the committable floor of the car is above the fire floor, but test 54 indicates that the car is not heading up, but rather is heading down, a negative result reaches a step 58 to set the destination for the selected car to be the fire floor, and a step 59 which sets a car selected flag, indicating that the car to be commandeered has already been chosen, for use hereinafter. In a similar fashion, a test 63 determines if the car can only stop below the fire floor, and a test 64 determines if the car direction is down, which would then indicate it is heading away from the fire floor. If so, a pair of steps 65, 66 will set the destination for the car equal to its committable floor but in this case will set the direction for car C equal up flag for use hereinafter, and then a step 67 sets the reverse flag. If the committable floor of the car is below the floor, but the car is heading up, a negative result of test 64 will also reach the steps 58 and 59. If the committable floor of the car is at the fire floor, then a negative result of test 63 will reach the steps 58 and 59. In any event, other programming is then reached through the return point 35.

Assuming that either step 57 or step 67 has been reached to set the reverse flag, in the next pass through the routine of FIG. 3, tests 31 and 32 are negative but now test 33 is positive, reaching a test 70 to see if the selected car C, is running or not. Since it can be assumed that a selected car will be running, test 70 will be affirmative until the car reaches its committable floor to reverse itself. When that happens, in a subsequent pass through FIG. 3, test 70 will be negative reaching a test 71 to determine if the direction for car C equal up flag was set in step 66 or reset in step 56. If it is set, a step 72 sets the direction for car C to up. But if it was reset, a step 73 sets the direction for car C to down. In this way, the car is directed toward the fire floor. Then, a series of steps 74–77 set the destination for car C equal to the fire floor, set the run command for car C, reset the reverse flag, and set the car selected flag.

Figure 4:
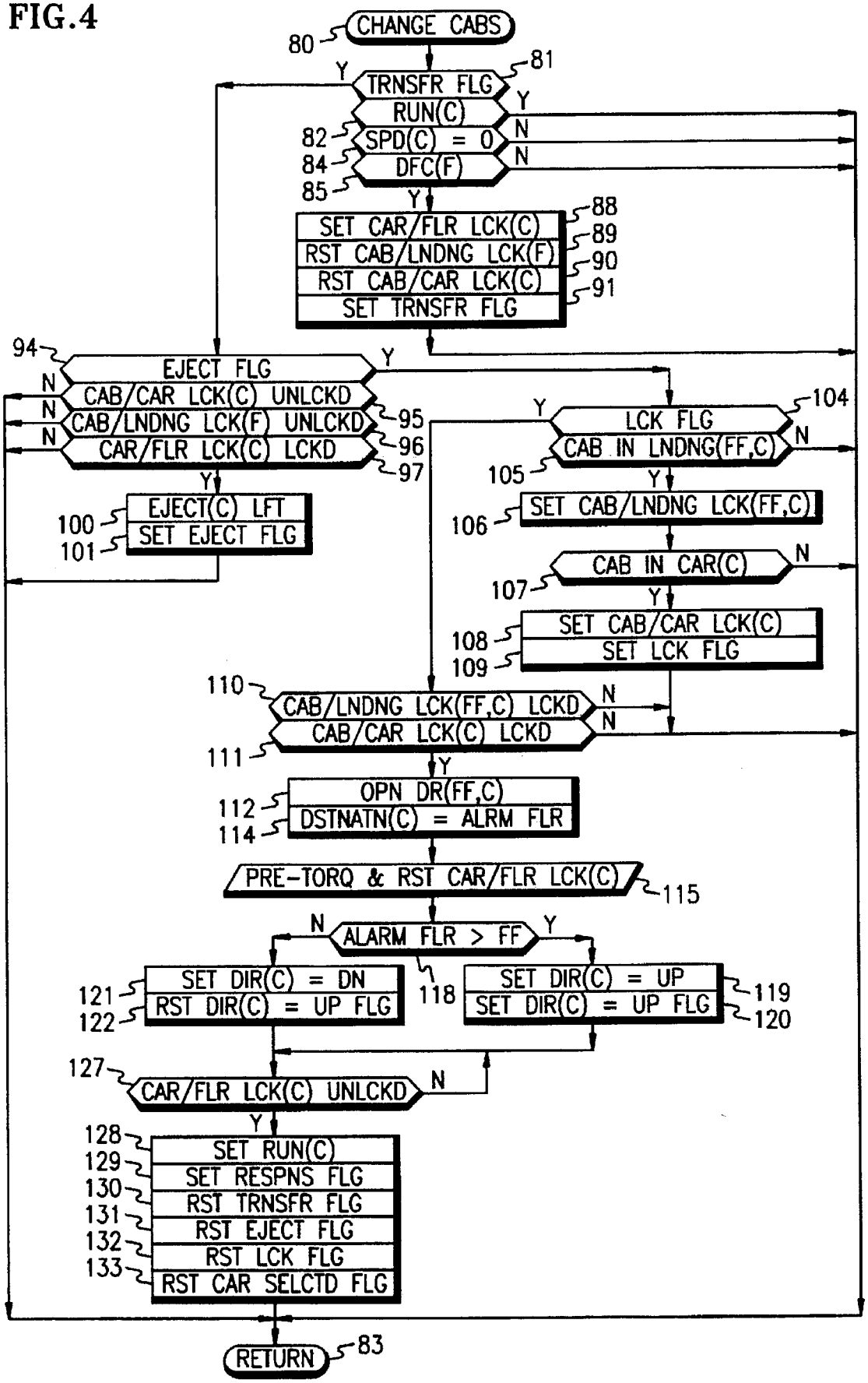
FIG. 4 is a logic flow diagram of a change cabs routing for use in the various embodiments of the invention.

In a subsequent pass through FIG. 3, following either step 77 or step 59 in which the car selected flag is set, test 31 will be negative but test 32 will be affirmative reaching the change cabs routine of FIG. 4 through a transfer point 80.

In FIG. 4, a first test 81 determines if the transfer flag (used to advance the program as described hereinafter) has been set or not. Initially, it will not have been set, so a test 82 determines if car C is still running. In the first pass, car C will generally still be running so an affirmative result of test 82 causes other programming to be reached through a return point 83. Eventually, car C will come to a stop at the fire floor and in a subsequent pass through FIG. 4, test 82 will be negative reaching a test 84 to check that the speed of car C is zero. If it is not, then the routine is bypassed and other programming is reached through the return point 83. If the speed of car C is zero, a test 85 determines if the door of the fire cab is fully closed, or not. Normally, when the alarm goes off, the firefighters will enter the cab and press the door close button so as to prepare to be moved to the fire. However, until this happens, the programming must wait. Therefore, if the doors are not closed, a negative result of test 85 will simply cause other programming to be reached through the return point 83. Eventually, the firemen are aboard the cab and its doors are closed. Then, an affirmative result of test 85 will reach step 88 to set the car/floor lock of car C, so as to rigidly support the car at the fire floor. Then, a step 89 will reset a cab/landing lock for the fire cab, thereby releasing the cab from its normal parking place on the landing. And similarly, a step 90 will reset the cab car lock for car C so that the cab thereon can be exchanged for the fire cab. A step 91 then sets the transfer flag, indicating that the cabs can be transferred from a landing to the car and from the car to a landing.

In a subsequent pass through the routine of FIG. 3, test 31 is negative, test 32 is affirmative reaching FIG. 4 in which test 81 is now affirmative. This reaches a test 94 to see if an eject flag, used to keep track of the time when the cabs are in motion in their exchange from landing to car and car to landing, has been set. Initially, the eject flag is not set so a negative result of test 94 reaches tests 95 to see if the cab car lock for car C and the fire cab are as yet unlocked, and a test 97 to see whether car C is locked to the floor. In a first pass through them, all of the tests 95–97 will typically be negative, causing other programming to be reached through the return point 83. Eventually, when both cabs are unlocked and the car is locked to the floor, all of the tests 95–97 will be affirmative so that a step 100 will order car C to eject its normal cab to the left, and simultaneously cause the fire cab to be received from the right (assuming the configuration disclosed in FIGS. 1 and 2 hereinbefore). Then a step 101 will set the eject flag, and other programming is reached through the return point 83.

In the next pass through the routine of FIG. 3, test 31 is still negative, test 32 is positive reaching test 81 which is still affirmative. This reaches test 94 again which is now affirmative reaching a test 104 to determine if a lock flag (described hereinafter) is set, or not. Originally, it is not, so a negative result of test 104 reaches a test 105 to see if the normal cab is fully on the landing of car C on the fire floor yet, or not. Originally, it will not be so a negative result reaches the return point 83. In a subsequent pass through the routine, eventually, the cab which has been ejected from car C is firmly in the landing on the fire floor, so an affirmative result of test 105 causes the lock for that cab to be set in a step 106. Then a test 107 determines if the fire car has been firmly placed in car C. By this time, it may have; if not, the return point 83 is reached; if so, an affirmative result of test 107 reaches a step 108 to set the cab car lock for car C, so as to lock the fire cab into car C, in a step 109 which sets the lock flag.

In the next pass through the routine of FIG. 3, test 31 is negative, tests 32 and 81 are affirmative, tests 94 and 104 are affirmative, reaching a pair of tests 110, 111 to determine if both cabs are locked yet or not. If not, the return point 83 is reached. If so, affirmative results of both tests 110 and 111 reach a step 112 to open the doors of the cab of car C on the fire floor landing (FF,C) so that passengers can be guided to local elevators to resume their trips. Then a step 114 sets the destination floor for car C equal to the alarm floor, where the fire is. Then a subroutine 115 is reached which will pretorque the elevator motor, thereby relieving the strain from the floor locks, and cause the floor locks to be retracted.

The fire cab is about to be moved from the fire floor to the alarm floor where the fire alarm was registered. A test 118 determines if the alarm floor is above the fire floor. (As used herein, to designate a target floor for a fire, the alarm floor may be set one or two floors below the floor where the alarm was registered, if desired.) If it is, a pair of steps 119, 120 will set the direction for car C to up and set a direction for car C equals up flag, for use hereinafter. On the other hand, if the alarm floor is not above the fire floor, it must be below it since this part of the program is not reached whenever the fire floor and the alarm floor are the same due to test 35 in FIG. 3. Therefore, a negative result of test 118 reaches a pair of steps 121, 122 which set the direction for car C down and reset the direction for car C equals up flag. Then, the program may cycle on a test 127 to determine that the car floor locks of car C are unlocked. If it is inappropriate to hold the program at this point while the locks are released (which may take a second or so), an unlock flag may be used to allow other programming to be reached at the return point 83 until such time as the locks are unlocked. Once the car floor lock is unlocked, an affirmative result of test 127 reaches a pair of steps 128 and 129 to set car C into the run state, and to set a response flag, to control the program as described more fully hereinafter. Then a plurality of steps 130–133 reset the response, transfer, eject, lock and car selected flags, and other programming is reverted to through the return point 83. Throughout this description, it is assumed that once a car is given a run command, it will run to the designated destination in response to its normal motion control means. When it gets to its destination, it will decelerate in the usual way and become level at the intended landing or adjacent the intended hoistway doors.

Figure 5A:
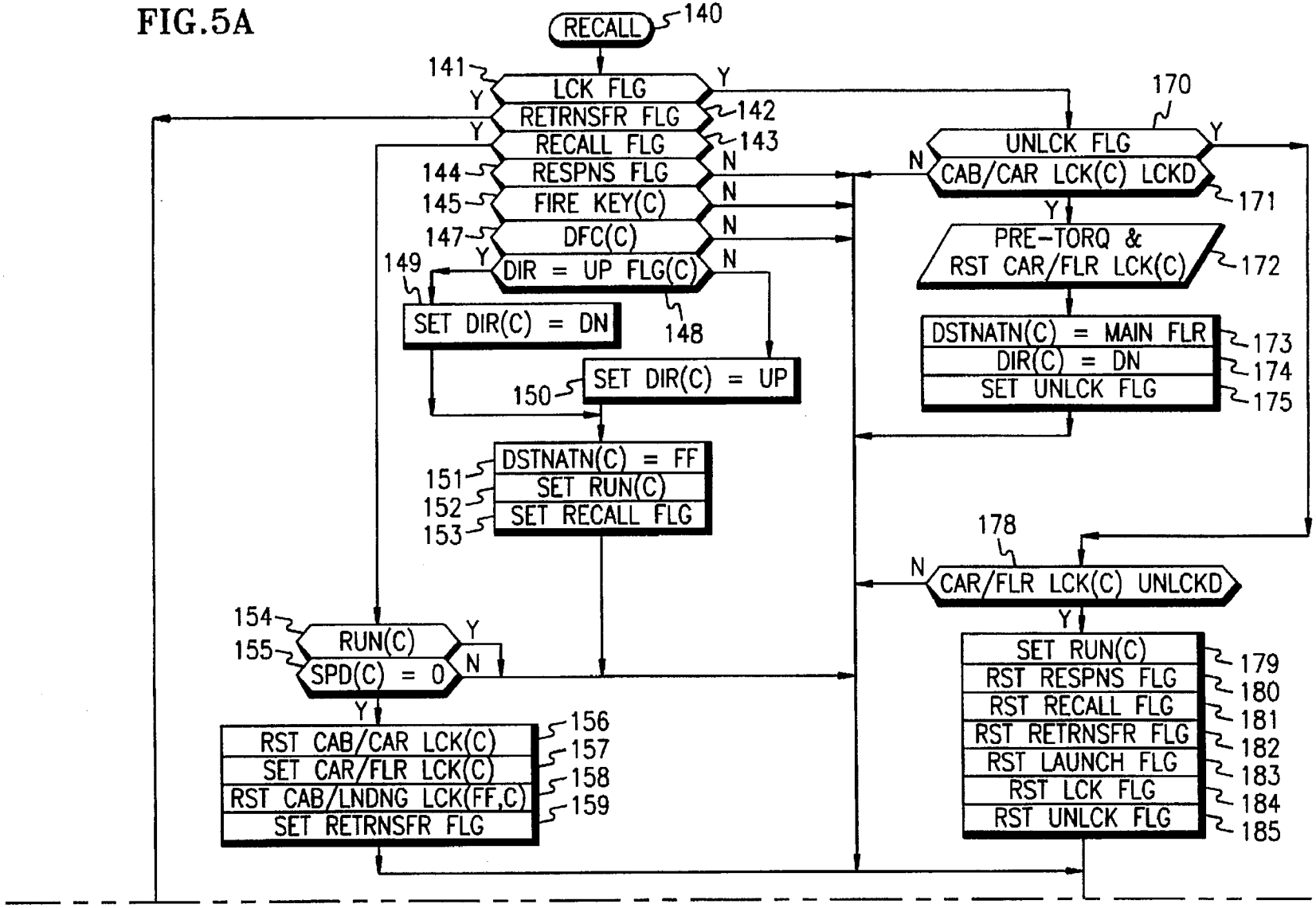
FIG. 5 is a logic flow diagram of a recall routine for use with the various embodiments of the present invention.
Figure 5B:
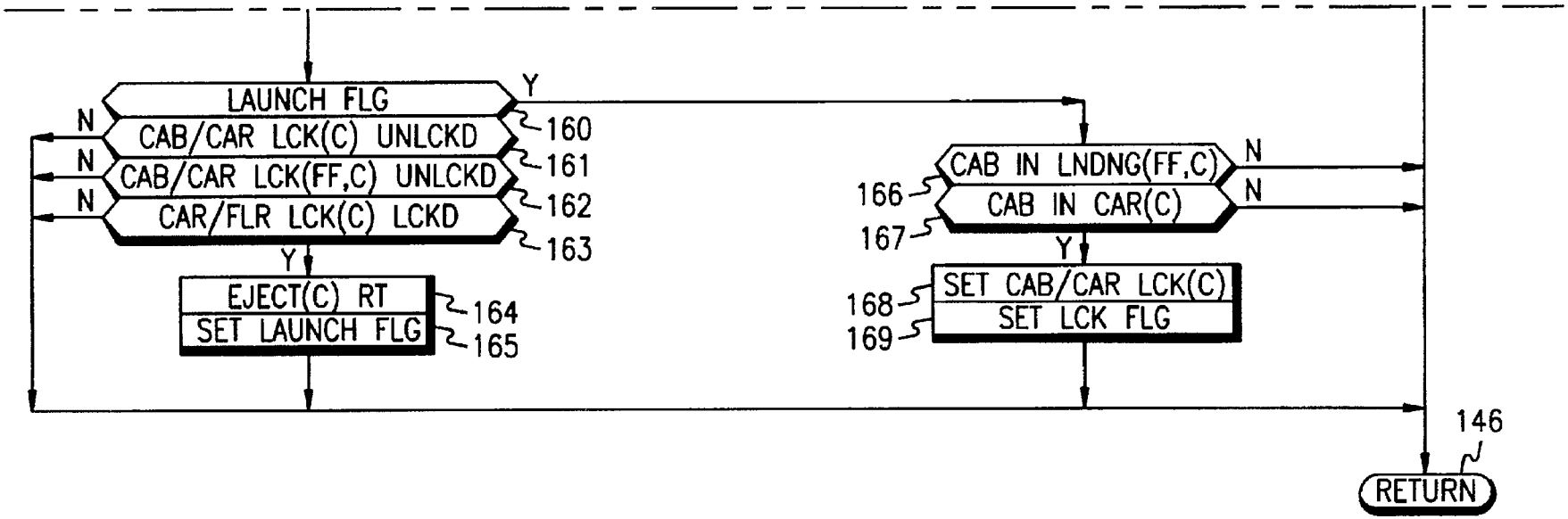
Figure 5:
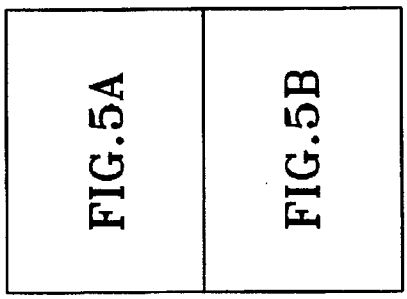

In the next pass through FIG. 3, test 31 is affirmative reaching the recall routine of FIG. 5 through a transfer point 140. At this point, car C has been enabled to run, and it is carrying the fire cab to the floor where the fire alarm was sounded. Because the destination for car C has been set to be the alarm floor, it will stop at that floor under its normal motion control. In the embodiment of FIGS. 1 and 2, the fire cab will remain on car C in the hoistway and access to the floor will be had through hoistway doors 26 (FIG. 2). In this embodiment of the invention, when the car stops, the firemen will control the car, including the opening of the doors, if desired. This is irrelevant to the present invention. In FIG. 5, a test 141 determines if the lock flag is set. Since it has been reset in step 132, FIG. 4, initially it will not be set, reaching a test 142 to see if the transfer flag is set. It also has just been reset in a step 130, therefore a negative result of test 142 reaches a test 143 to see if a recall flag, used to advance the program, has been set or not. Initially, it will not have been set, so a test 144 is reached to see if the response flag is set. The response flag having been set in step 129 of FIG. 4, an affirmative result of test 144 reaches a test 145 to see if a firemen's key to start up car C has been turned or not. While the fire is being responded to, test 145 will be negative causing other programming to be reverted to through a return point 146.

When the firemen are through dealing with the alarm on the alarm floor, they will enter the fire cab on car C and turn a key (or otherwise provide a key signal) causing the doors of the cab to close. In a subsequent pass through FIG. 5, test 145 will be affirmative reaching a test 147 to check for closed doors. Initially, this may be negative, causing the program to reach a return point 146. When the doors of the fire cab are closed, in a subsequent pass through the routine of FIG. 5, tests 141 and 142 are negative and tests 144, 145 and 147 are affirmative, thereby reaching a test 148 to determine if the direction equals up flag for car C was set or not. If the car had proceeded upwardly, it will have been set and a step 149 will set the direction for car C to down so that it may return to the fire floor. If the flag were reset in FIG. 3, then a negative result of test 150 reaches a step 150 to set the direction of car C to up so that car C can return to the fire floor. Then, a step 151 will set the destination of car C equal to the fire floor, a step 152 will set car C to run, and a step 153 will set a recall flag used to advance the program as described hereinafter.

At this point in time, the fire cab is riding in car C back towards its resting place on the fire floor. In the next subsequent pass through FIG. 5, tests 141 and 142 are negative, but this time test 143 is affirmative reaching a test 154 to see if car C is still in the run condition, which it will be until it becomes level at the fire floor. Initially, as the car approaches the fire floor, test 154 will be affirmative, causing other programming to be reached through the return point 146. Eventually, the car will be leveled at the fire floor and the run command will be reset for car C, in the usual fashion. In a subsequent pass through FIG. 5, test 154 is negative reaching a test 155 to determine if car C is perfectly at rest. If it is, an affirmative result of test 155 will reset the cab/car lock on car C in a step 156, thus releasing the fire cab. A step 157 will set the car/floor lock for car C so as to ensure there will no whipping of the rope as the cabs are exchanged on the car. And a step 158 will reset the cab/landing lock on the fire floor adjacent to car C, to release the normal cab that was jettisoned from car C in response to the fire alarm as car C was commandeered. And then a step 159 sets a retransfer flag to keep track of the fact that a reexchange of the original passenger car and the fire cab is about to take place. Then other programming is reached through the return point 146.

At this point in time, the process of retransferring the passenger cab (or other normal cab) to car C, as the fire cab is transferred to the fire floor, will take place. In the next pass through FIG. 5, test 141 is still negative, but test 142 is now positive, reaching a test 160 to determine if a launch flag (used to advance the program and described hereinafter) is set or not. Initially it will not be set, so a negative result of test 160 reaches a set of tests 161–163 to see if the fire cab has been unlocked on car C and passenger cab unlocked from the landing, and to see if car C has been locked to the building. In the first few passes through these tests, the result is likely to be negative, reaching the return point 146. When both cabs are unlocked and the car is locked, an affirmative result of test 161–163 reaches a step 164 to cause the car to eject the fire cab to the right (in the convention of FIGS. 1 and 2) which also will cause the passenger cab originally on car C to be loaded back onto car C. Then a step 165 sets a launch flag used to advance the program, which is described hereinafter. And other programming is then reverted to through the return point 146.

The setting of the launch flag indicates that the cabs are in transit, the normal cab originally on car C is moving back onto the car as the fire cab is being moved onto the fire floor. In the next pass through FIG. 5, test 141 is still negative, test 142 is still positive, but now test 160 is positive, reaching a pair of tests 166, 167 which determine if the fire cab is fully in place on the fire floor and the passenger cab is in place on car C. Initially, the cabs will not have been fully transferred so negative results reach other programming through the return point 146. When the cabs are both in place, in a subsequent pass through FIG. 5, test 141 is still negative, test 142 is positive, test 156 is positive and both tests 163 and 164 will be positive reaching a step 168 to set the cab car lock on car C, and a step 169 to set a lock flag used to control the program, as described hereinafter.

At this point in time, the cab lock for the fire cab is not being set since the fire cab may be returned to its normal resting place (adjacent car 5 in the exemplary embodiment). In the next pass through FIG. 5, test 141 is positive reaching a test 170 to see if an unlock flag has been set or not. Initially, it will not have been, so a negative result of test 170 reaches a test 171 to see if the passenger cab is locked in car C as yet, or not. If the lock is not yet locked, a negative result of test 170 and 171 reach the return point 146. When the lock is locked, an affirmative result of test 171 reaches a subroutine 172, similar to the subroutine 115 described with respect to FIG. 4, to take the strain off the car/floor locks and release them. Then, a step 173 sets the destination for car C to the main floor (or to any other floor which is desired) so that it can resume handling its normal function, which may be passenger traffic. Then the direction for car C is set to lead it towards its destination, which in this case would be down, by a step 174. Then, the unlock flag 175 is set in a step 175. In the next pass through the routine of FIG. 3, test 131 is still positive reaching the recall routine of FIG. 5 in which test 141 is still positive. This time, test 170 is positive, reaching a test 178 to determine if the car floor lock for car C has been released as yet or not. Until it does, the program will proceed through tests 31, 141, 170 and 178 to the return point 146. When the car floor lock of car C is unlocked, an affirmative result of test 178 reaches a step 179 to set car C into the run condition so that it can return to normal service. And then a plurality of steps 180–185 reset the response, recall, retransfer, launch, lock and unlock flags, and other programming is reached through the return point 146. As far as car C and the passenger cab are concerned, all that remains is to return to the main floor (or other designated return floor) to resume normal service.

Figure 6:
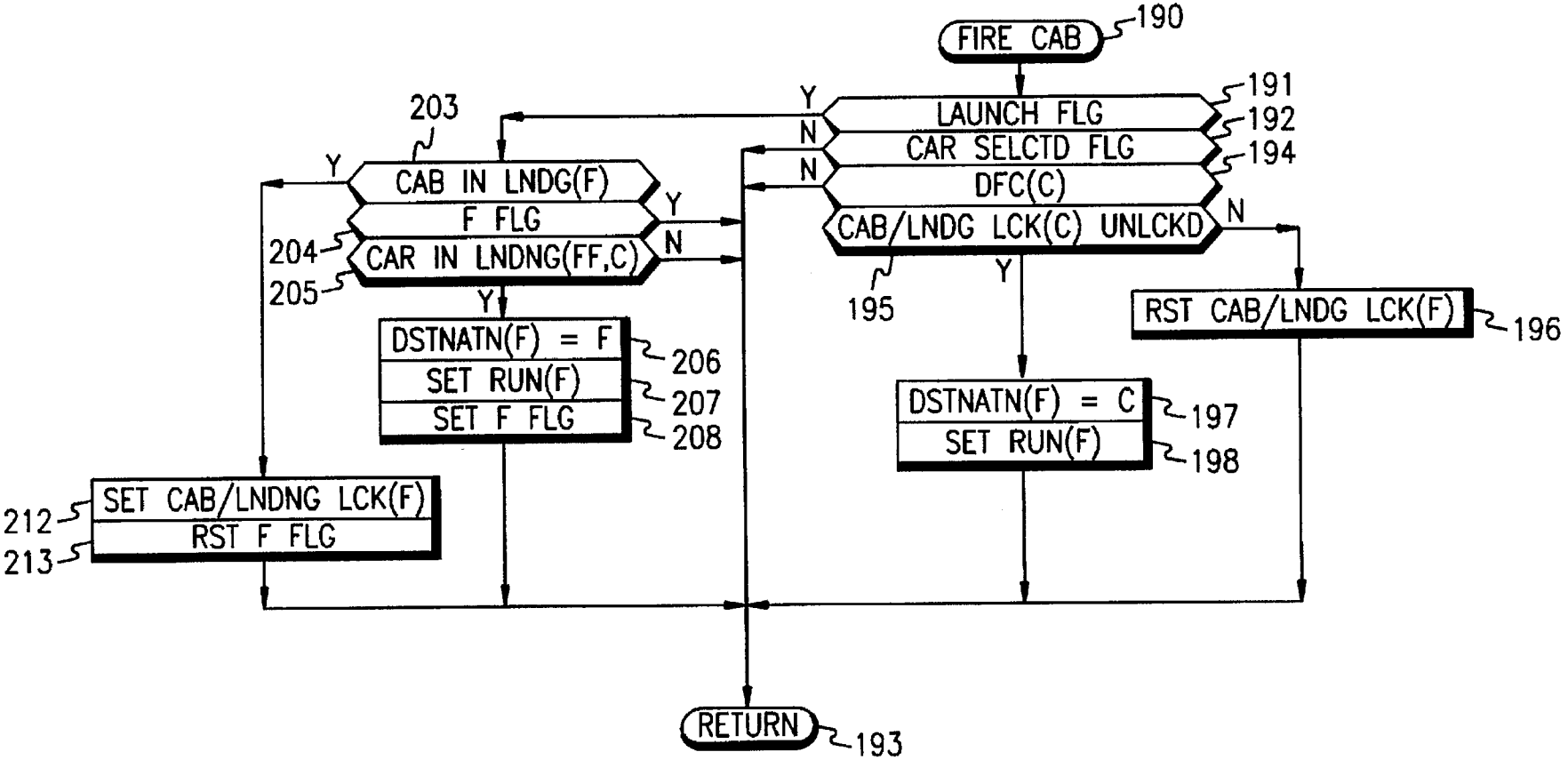
FIG. 6 is a logic flow diagram of a fire cab routine for use with the various embodiments of the present invention.

Referring to FIG. 6, a fire cab routine is reached through an entry point 190. A test 191 determines if the launch flag, of step 165 and test 160 in FIG. 5, has been set or not. When the alarm first goes off, and the fire is to be responded to, test 191 will be negative reaching a test 192 to see if the car selected flag (of steps 59 and 77 and test 32 of FIG. 3) has been set or not. In the initial stages of responding to a fire, or when there is no alarm to be responded to, test 192 will be negative reaching other programming through a return point 193. When there is a fire alarm and a car has been chosen to be commandeered for use in transporting the fire cab, test 192 will be affirmative reaching a test 194 to see if the door on the fire cab has been closed by the firemen. If not, the remainder of the program is bypassed to the return point 193. When the door on the fire cab is closed, an affirmative result of test 194 reaches a test 195 to see if the cab/landing lock for the fire cab is unlocked or not. Initially it is not, so a negative result of test 195 reaches a step 196 to reset the cab/landing lock for the fire cab. In a subsequent pass through FIG. 6, test 191 is negative, tests 192 and 194 are affirmative but until the fire cab is unlocked, test 195 will be negative, reinforcing the reset of the lock in step 196. Once the fire cab is unlocked, an affirmative result of test 195 reaches a step 197 which sets the horizontal destination for the fire cab to the position of car C (adjacent the hoistway of one of the elevators 1-9). And, the run command for the horizontal movement of the fire cab is set in a step 198. The fire cab will then run to a position adjacent to car C and be stopped by normal controls in response to its destination command, in any well-known manner (not shown). The handling of the fire cab is then as described with respect to FIGS. 3–5 until the fire cab is returned to the fire floor.

In interim passes through the routine of FIG. 6, after the fire car has been moved horizontally to be adjacent to car C, the routine may proceed through a negative result of test 191, and affirmative results of tests 192, 194 and 195 causing a redundant resetting of the destination of the fire cab to the position of car C and setting run for the fire cab. But since the cab is at its destination, nothing will happen. As soon as the cab is moved toward car C, leaving the fire floor, it will lose its communication with the fire floor, and establish communication with car C. Therefore, the door fully closed signal for the fire cab which is tested in test 194 will become negative reaching the return point 193. Soon thereafter, the car selected flag is reset in step 133 of FIG. 4 so that subsequent passes through FIG. 6 will pass through negative results of tests 191 and 192 to the return point 193. This will continue until after responding to the alarm, the launch flag is set in step 165, indicating that the fire cab is being returned to the fire floor. When this happens, in a subsequent pass through FIG. 6, test 191 is affirmative reaching a test 203 to determine if the fire cab is fully in its own landing, F. Initially, it will not be, so a negative result of test 203 reaches a test 204 to see if an F flag, used to advance the program, has been set or not. Initially, the flag will not be set so a negative result of test 204 will reach a test 205 to see if the cab has arrived on the fire floor adjacent to car C, or not. When the launch flag is first set, initially, the cab will be moving from car C toward the landing on the fire floor, so a negative result of test 205 will reach the return point 193. Eventually, the fire cab will be disposed fully on the landing adjacent to car C on the fire floor, so an affirmative result of test 205 will reach a step 206 to set the destination for the fire cab to its normal resting place, referred to as F. Then the fire cab is enabled to run by a step 207, and the F flag is set in a step 208. In the next pass through the routine of FIG. 6, the fire cab has probably not reached its landing, F, so test 203 is probably still negative. However, test 204 will be affirmative so that the rest of the routine is bypassed during the time that the fire cab moves from the position of car C to the position where it rests. Eventually, the fire cab will reach the landing where it normally resides to that in a subsequent pass through FIG. 6, test 203 will be affirmative reaching a step 212 which orders that the fire cab be locked in its landing, and a step 213 which restores the F flag to the reset state. This concludes the entire operation from fire alarm to the restoration of the system to the way it is before the alarm.

Figure 7:
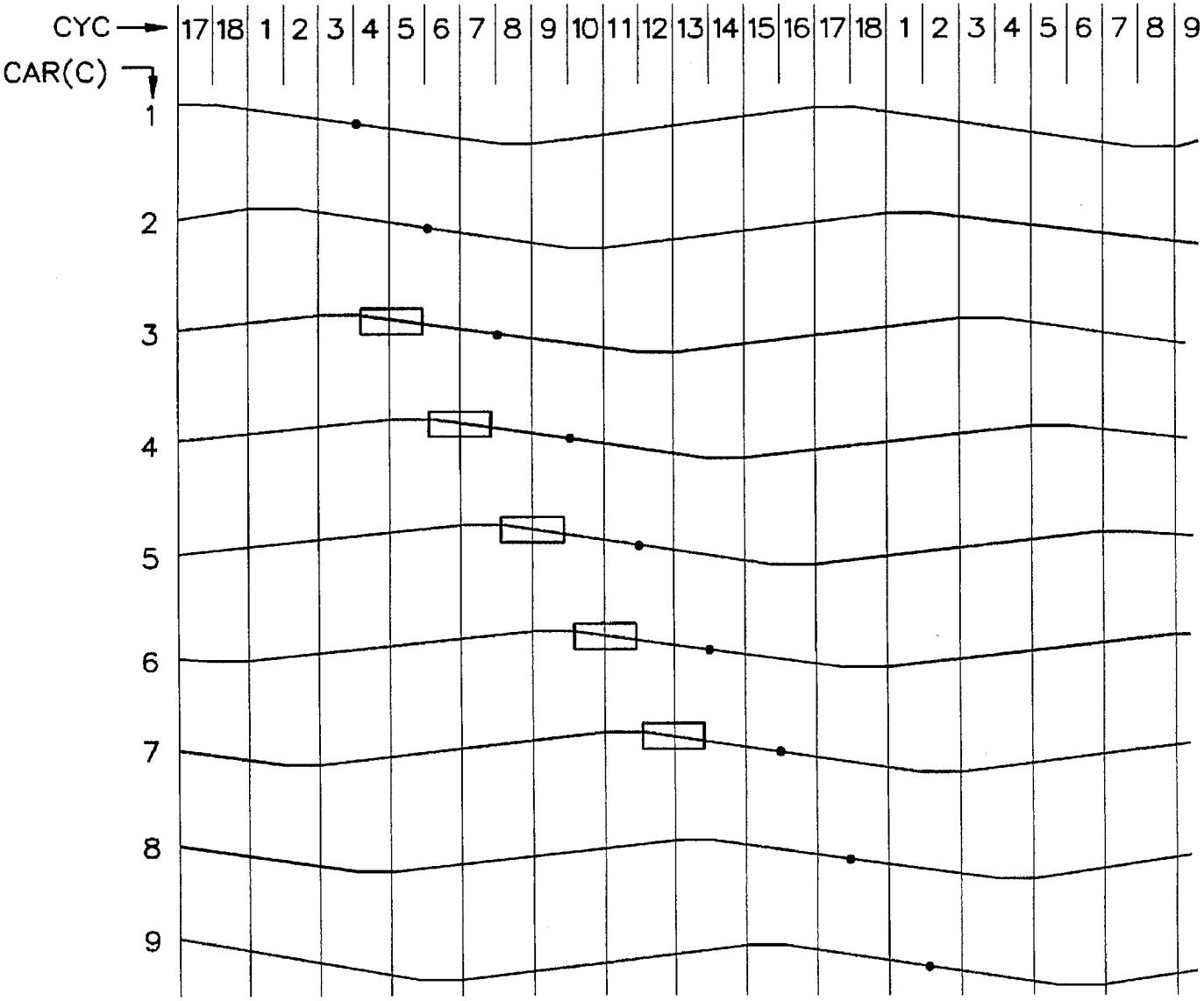
FIG. 7 is a timing diagram illustrative of a second embodiment of the invention in which the cars of the shuttle system are dispatched in a synchronized sequence.

The embodiment of FIGS. 1 and 2 hereinbefore has been assumed to allow each of the elevators 1–9 to operate independently of the others, and therefore, the routine of FIG. 3 between step 38 and test 50 selects a car on a universal basis to be used for carrying the fire cab. The invention may also be practiced in an elevator system in which the elevators 1–9 are operated in a synchronized fashion. An example of a nine elevator system synchronized in 18 periods is illustrated in FIG. 7. In FIG. 7, the cycles appear across the top. In FIG. 7, car one is at the high landing during the 17th cycle and leaves the landing heading downward at the beginning of the 18th cycle. It reaches the bottom landing 14 (FIG. 1) at the beginning of cycle 8 where a passenger cab is exchanged with another passenger cab, and it leaves in an upward direction at the beginning of cycle 9, and so forth. As an example, assume that the elevators 1–9 may span 80 floors, and the fire floor may be at the 40th floor. This would mean car one would reach the fire floor halfway in its downward run, at the beginning of cycle four. Similarly, car one would reach the fire floor at the start of cycle 13 or thereabouts during its upward run. For ease in understanding this embodiment, a dot has been placed at the points which approximate the position within a run where the various cars would be at the fire floor. If there are 80 floors and the hoisting machinery could accelerate on the order of one meter per second squared and have a rated velocity of about ten meters per second, it would take close to ten seconds for acceleration and deceleration. Under these conditions, each of the cycles would be on the order of four seconds. Therefore, in order to pick a car whose committable floor was not past the fire floor, the car would have to be selected essentially two cycles ahead of the time in which it would reach the fire floor. These periods of time have been marked with rectangles for cars 3–7. In the case of cars 3 and 7, since it will take on the order of three or four seconds for the fire cab to reach the position of car 3 or car 7, either of these cars must be selected so that the cab knows it must travel to one of these cars three or four seconds earlier than any of car four, five or six. If car five is selected, the fire cab is already positioned in the right place; if car four or car six is selected, the fire cab can reach one of those cars by the time that one of those cars can stop. Cars 1, 2, 8 and 9 cannot be selected in time for the cab to reach them and be ahead of a time that one of the cars 3–7 could be selected and reach the fire floor. Thus, there is no circumstance in which, in the embodiment depicted in FIG. 7, cars 1, 2, 8 and 9 would be a choice over one of the cars 3–7. For this reason, no rectangles are shown for them.

Figure 8:
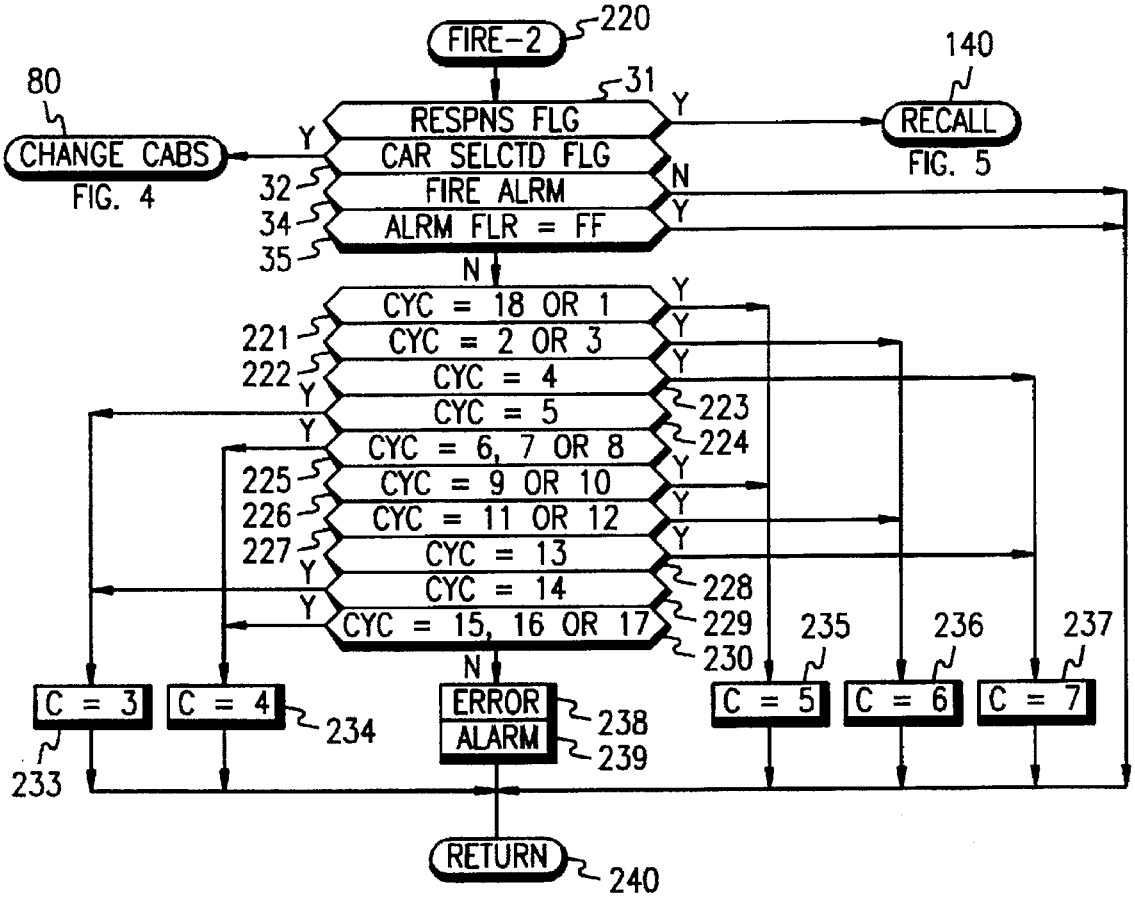
FIG. 8 is a logic flow diagram of a second fire routine, for use with the synchronized embodiment of the present invention.
Figure 10:
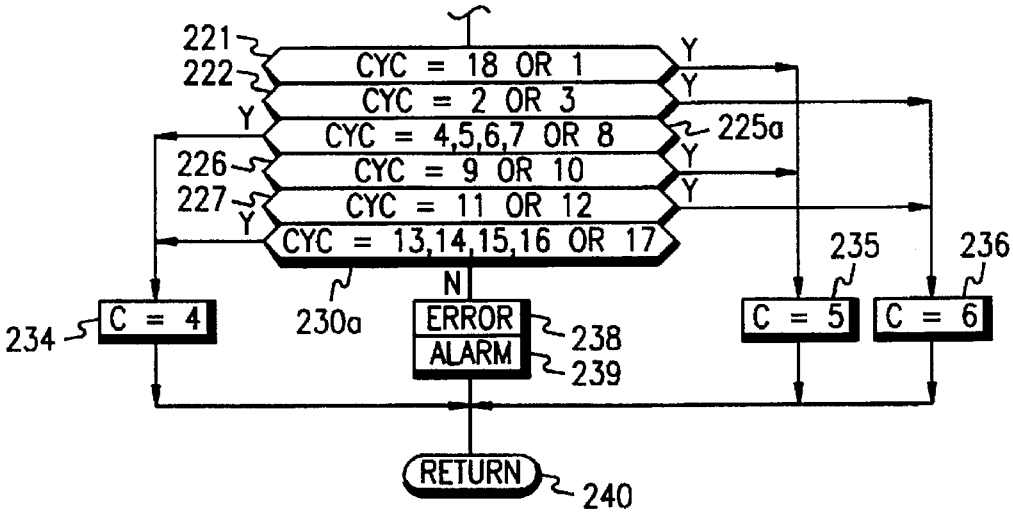
FIG. 10 is a partial logic flow diagram of a variation of the fire routine of FIG. 8, for use with the embodiment of FIGS. 9 and 10.

FIG. 8 illustrates a second embodiment of the present invention, within the structure illustrated in the embodiment of FIGS. 1 and 2, but utilizing synchronized dispatching of the various cars as in FIG. 7. In FIG. 8, a second fire routine is reached through an entry point 220, and the first two tests 31, 32, are the same as described hereinbefore with respect to FIG. 3. In this embodiment, no reverse flag is needed since the chosen car is always heading toward the fire floor. The tests 34 and 35 are the same as described with respect to FIG. 3, and will not be described further. However, when there is a fire alarm and the alarm is not on the fire floor, a negative result of test 35 reaches a whole series of tests 221–230 to pick one of the cars in a series of steps 233–237, as the designated car C, in dependence upon the current cycle when a negative result of test 35 is first reached. As an example, in cycle 18, it is too late to cause car four to stop at the fire floor, so car five is chosen instead. Car five remains the car of choice during the first cycle. But during the second cycle, it is too late for car five so car six is selected, and so forth. Under the scheme depicted in FIGS. 7 and 8, the longest time it would take for a car to reach the fire floor would be on the order of 20 seconds for car four, if the alarm went off before the beginning of the sixth cycle, allowing some time for acceleration and deceleration of car four. It should be understood that FIGS. 7 and 8 are not descriptive of an exact working model, but rather are illustrative of an embodiment of the invention that selects a car heading for the fire floor which will be the next car that can get there. If desired, should there be a negative result from the test 230, an appropriate error could be noted and an alarm sounded in steps 238, 239 since obviously the system would not select the car. In any event, after one of the steps 233–239, other programming is reverted to through the return point 240.

Figure 9:
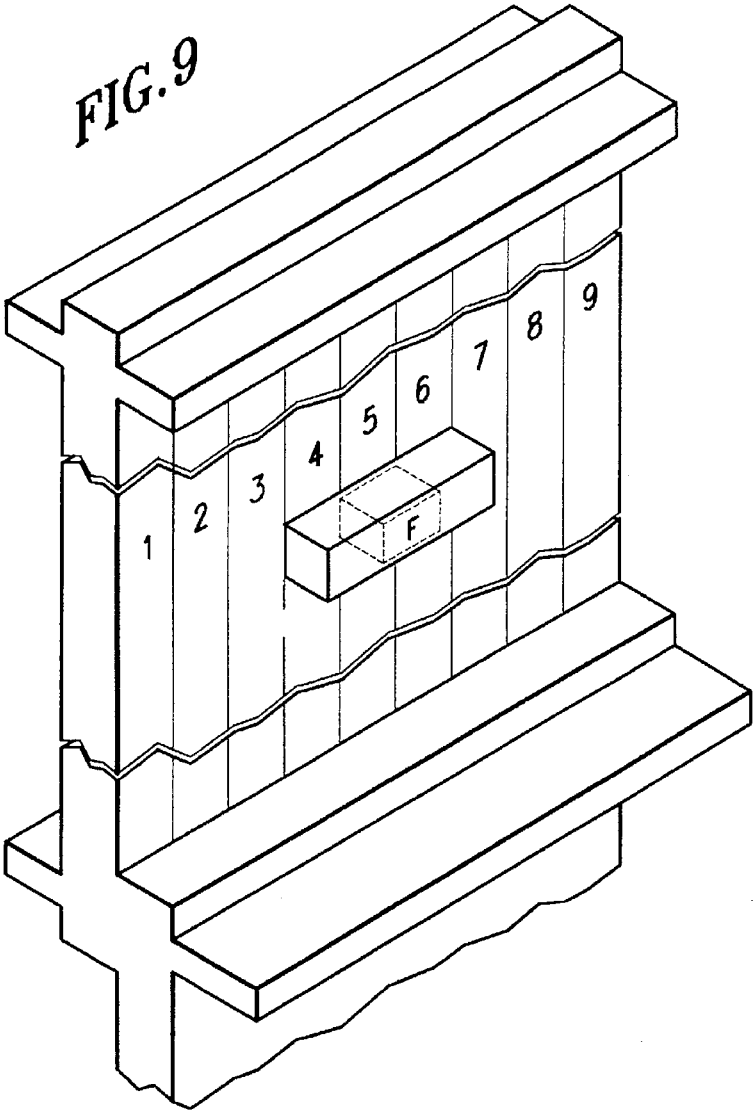
FIG. 9 is a stylized, simplified perspective view of a bank of shuttle elevators in which only three of the elevators have landings between the terminal landings.
Figure 11:
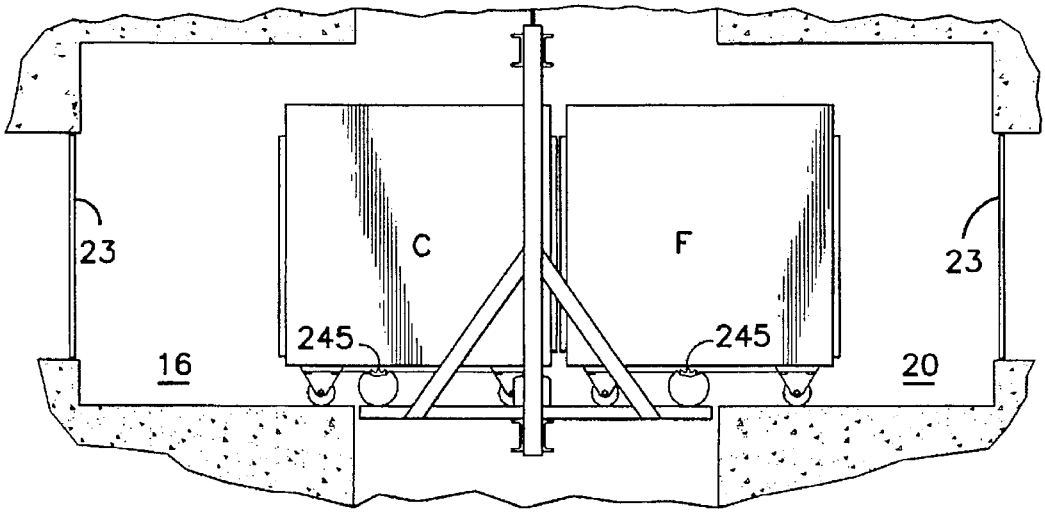
FIG. 11 is a partial, sectioned side elevation view of an alternative embodiment of the present invention.

The embodiment of FIGS. 1 and 2 utilizes a fire floor which has complete landings on both sides of the elevator hoistways so that any car could be eligible, even though in the modification illustrated in FIGS. 7 and 8, cars 1, 2, 8 and 9 would not be selected, such cars may be selected in the embodiment of FIG. 3. A different embodiment of the invention, FIG. 9, utilizes only three of the cars 4–6 as possible candidates for commandeering to carry the fire cab to a floor where an alarm has been set; the three cars 4–6 have full landings (not shown) on the opposite side from where the fire cab is parked. In such a case, the routine of FIG. 8 can be modified as shown in FIG. 11 to use only cars 4–6, the change principally comprising not utilizing tests 223, 224, 228 and 229, and increasing the cycles to which tests 225 and 230 are responsive as shown by the tests 225*a* and 230*a* so that car four is selected more of the time instead of cars 3 and 7.

The invention could be utilized with double deck cabs. In such a case, when the doors of the fire cab open for the firemen, the doors of the upper deck cab can open, and open the doors 27 adjacent thereto, to allow the upper deck passengers to seek an alternative route to their destination.

For clarity of understanding, the foregoing embodiments have been described with respect to a fire cab responding to a registered fire alarm. However, the cab might be any form of emergency cab, such as an ambulance, or other medical emergency cab. In all of the embodiments herein, the dispatching of one emergency car may frequently be accompanied by the dispatching of another emergency cab. For instance, once the fire cab had caused a car to be selected for commandeering so that the fire cab could leave one floor (such as the 40th floor) to respond to an alarm, a medical emergency cab could select a second car to be commandeered for carrying the medical emergency cab to the same or a different floor in response to the same alarm or another demand for service, from a different floor, such as the 39th or 41st floor. Of course, any floor may be chosen. In the embodiments herein, it is assumed that the emergency cab is disposed in a hoistway which interconnects with another hoistway. Thus, it is possible that the cab in the present instance could have as its destination a floor in the lower bank 13 of shuttles, rather than in the upper bank of shuttles, going through a transfer between cars at the transfer floor. This is particularly true in the case where a second emergency cab is being dispatched from one bank of elevators (12, 13) to the other bank of elevators (13, 12) to back up an emergency cab already dispatched from a floor in one bank of elevators (13) to respond to an emergency in the same bank of elevators (12, 13).

The invention may also be practiced in embodiments of elevator shuttles which do not normally transfer cabs onto landings, but do transfer cabs from one hoistway to another. In such a case, a special landing for the fire cab and for the normal cab to be removed from a selected car may be provided as shown in FIG. 11, in which the horizontal motive means of FIG. 12 may preferably be used for transferring the cabs between the car and the landings, including motorized pinions 260, 255.

Figure 12:
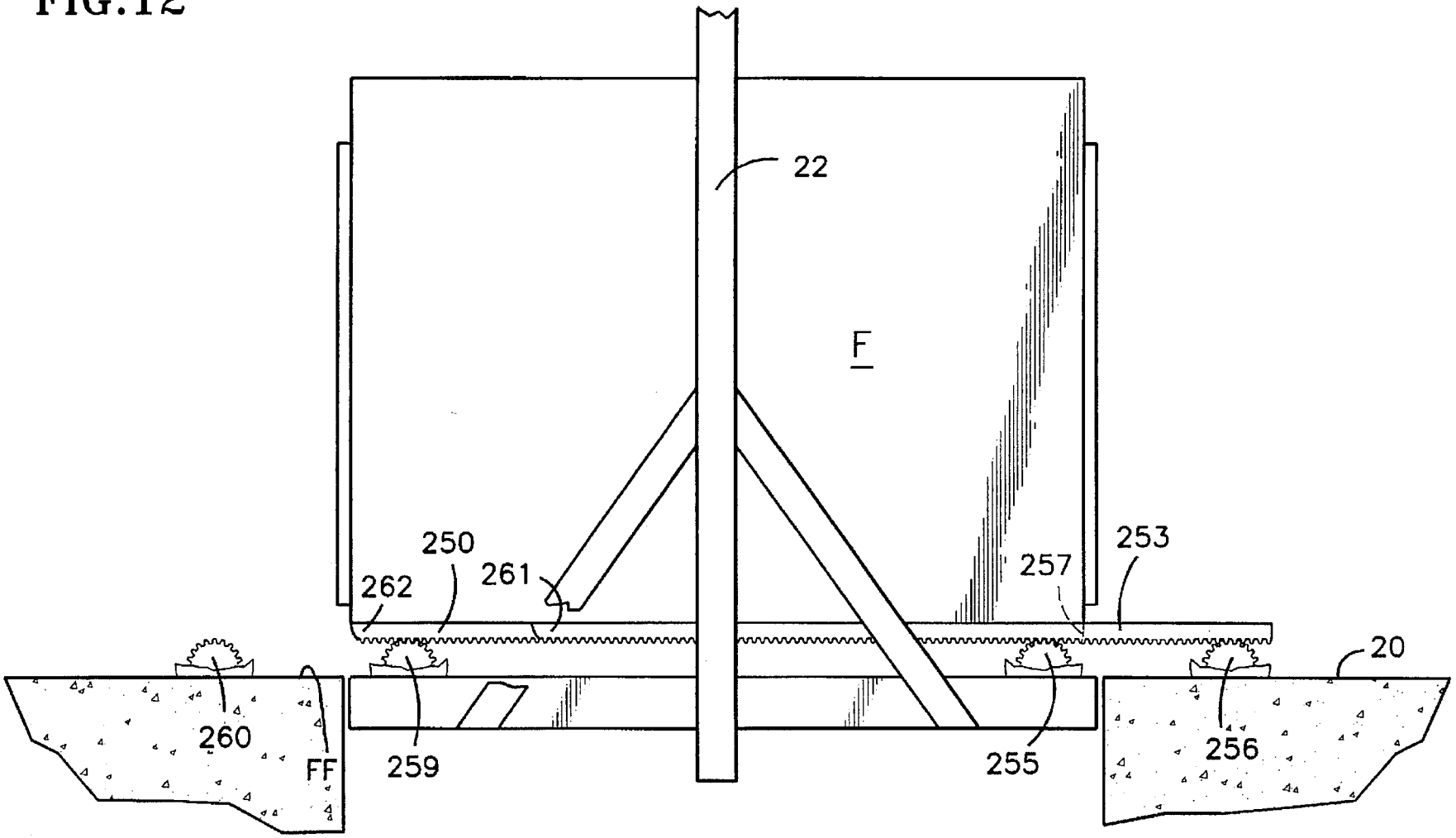
FIG. 12 is a simplified side elevation view of a car frame and cab at a landing, illustrating a horizontal motive means.

In FIG. 12, the bottom of the cab F has a fixed, main rack 250 extending from front to back (right to left in FIG. 12), and a sliding rack 253 that can slide outwardly to the right, as shown, or to the left. There are a total of four motorized pinions on each of the car frame platforms. First, an auxiliary motorized pinion 255 turns clockwise to drive the sliding auxiliary rack 253 out from under the cab into the position shown, where it can engage an auxiliary motorized pinion 256 on the landing 20, which is the limit that the rack 253 can slide. Then, the auxiliary motorized pinion 256 will turn clockwise pulling the auxiliary rack 253 (which now is extended to its limit) and therefore the entire cab F to the right as seen in FIG. 12 until such time as an end 257 of the main rack 250 engages a main motorized pinion (not shown) which is located just behind the auxiliary motorized pinion 256 in FIG. 12. Then, that main motorized pinion will pull the entire cab 22 fully onto the landing 20 by means of the main rack 250, and as it does so a spring causes the slidable auxiliary rack 253 to retract under the cab 22. Auxiliary motorized pinions 259,260 can assist in moving a cab to the right to the landing FF, and can also assist in moving cab C from the landing FF onto the car frame 22.

To load the cab F from the platform 20 to the car frame 22, the auxiliary pinion 256 will operate counterclockwise, causing the sliding, auxiliary rack 253 to move outwardly to the left until its left end 261 engages the auxiliary pinion 255. Then the auxiliary pinion 256 pulls the auxiliary rack 253 and the entire cab F to the left until the left end 262 of the main rack engages a main motorized pinion (not shown) located behind the auxiliary motorized pinion 255, which then pulls the entire cab to the left until it is fully on the car frame 22.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. In a building having a plurality of shuttle elevators, each with a car frame for receiving cabs from landings, moving cabs vertically in said building, and delivering cabs to landings, a method of moving an emergency cab from a first floor of said building on which it parks when not in use to a second floor of said building where a request for corresponding emergency service has been registered, comprising:

(a) in response to a registered request for emergency service, selecting one of said elevators to be commandeered to move said emergency cab;

(b) bringing the selected elevator to rest at said first floor with said emergency cab on a first landing on said first floor adjacent the car frame of said selected elevator;

(c) moving a cab from said car frame onto a second landing on said first floor and moving said emergency cab from said first landing onto said car frame; and (d) moving said emergency cab on said car frame vertically to said second floor.

2. A method according to claim 1 further comprising:

(e) providing an indication that the request for emergency service has been responded to;

(f) in response to said indication, moving said emergency cab on said car frame vertically to said first floor; and (g) moving said emergency cab from said car frame onto said first landing and moving the cab which is on said second landing from said second landing onto said car frame.

3. A method according to claim 2 further comprising:

after said step (g), dispatching said car frame to a designated floor in said building.

4. An elevator system in a building, comprising:

a plurality of elevators, each having a car frame moveable in a hoistway between terminal floors of said building;

a plurality of normal elevator cabs for providing non-emergency service in said hoistways;

horizontal motion means associated with each elevator for horizontally moving cabs onto the corresponding one of said car frames and for horizontally moving cabs off the corresponding one of said car frames;

an emergency cab disposed when not in use on a first landing on a first floor of said building between said terminal floors and adjacent to the hoistways of said elevators;

an alarm for providing an alarm signal indicative of a request for emergency service associated with said emergency cab and for providing an indication of the floor of the building on which said emergency service is requested; and a signal processing controller responsive to said alarm signal for selecting one of said elevators to be commandeered for use in responding to said request for service, for causing the car frame of the selected one of said elevators to come to rest at said first floor with said emergency cab disposed adjacent said selected car frame, for causing said horizontal motion means to transfer a normal cab from said selected car frame onto a second landing on said first floor and to transfer said emergency cab onto said selected car frame, and for causing said car frame to move said emergency cab to the floor of the building on which said emergency service is requested.

5. A system according to claim 4 further comprising:

means operable to signify that said emergency cab should return to said first landing and providing a key signal indicative thereof; and said signal processing controller comprises means responsive to said key signal for moving said emergency cab on said car frame to said first landing and for causing said horizontal motion means to transfer said emergency cab from said selected car frame to said first landing and to transfer said normal cab from said second landing to said selected car frame.

* * * * *